US006746549B2

(12) United States Patent
Song et al.

(10) Patent No.: US 6,746,549 B2
(45) Date of Patent: Jun. 8, 2004

(54) YW35 STEEL AND A LOW TEMPERATURE FISHPLATE MADE OF THE SAME

(76) Inventors: Renzhen Song, An Gang Fu Qi Da Xing Zha Gang Chang, He Nan Jing Ji Kai Fa Qu, LIu Er Pu, Liao Yang Xian, Liao Ning Province (CN), 111212; Xizhe Jiang, An Gang Fu Qi Da Xing Zha Gang Chang, He Nan Jing Ji Kai Fa Qu, LI u Er Pu, Lia Yang Xian, Liao Ning Province (CN), 111212; Jinchang Chen, An Gang Fu Qi Da Zing Zha Gang Chang, He Nan Jing Ji Kai Fa Qu, LIu Er Pu, Liao Yang Xian, Liao Ning Province (CN), 111212

( * ) Notice: Subject to any disclaimer, the term of this patent is extended or adjusted under 35 U.S.C. 154(b) by 25 days.

(21) Appl. No.: 10/134,565

(22) Filed: Apr. 26, 2002

(65) Prior Publication Data

US 2003/0124020 A1 Jul. 3, 2003

(30) Foreign Application Priority Data

Dec. 28, 2001 (CN) ..... 01138962 A
Dec. 28, 2001 (CN) ..... 01277561 U

(51) Int. Cl.[7] ..... C22C 38/04; C22C 38/02; C22C 38/12

(52) U.S. Cl. ..... 148/320; 420/124

(58) Field of Search ..... 148/320; 420/124, 420/123, 127

(56) References Cited

U.S. PATENT DOCUMENTS 5,676,772 A * 10/1997 Kobayashi et al. ..... 148/333
6,254,696 B1 * 7/2001 Ueda et al. ..... 148/328

* cited by examiner

*Primary Examiner*—Deborah Yee
(74) *Attorney, Agent, or Firm*—Knobbe, Martens, Olson & Bear, LLP

(57) ABSTRACT

A Nickel free high manganese YW35 steel which has high strength and high tenacity at low temperature, and a fishplate made of the same. The YW35 steel for steel rail fishplate is produced by adding a selected amount of Molybdenum and microelement Vanadium and Niobium in a high Manganese steel and reducing the carbon content thereof, to thereby improve the low temperature property of the steel. The YW35 steel has (by weight percentage): C: 0.32~0.40, MN: 1.10~1.30, Is: 0.30~0.50, p: <0.035, S: <0.035, MO: 0.15~0.25, V: 0.06~0.20, NB: 0.04~0.07, Cu: <0.20, and a balancing amount of Fe.

2 Claims, 1 Drawing Sheet

YW35 STEEL AND A LOW TEMPERATURE FISHPLATE MADE OF THE SAME

Related Applications

Figure 1:
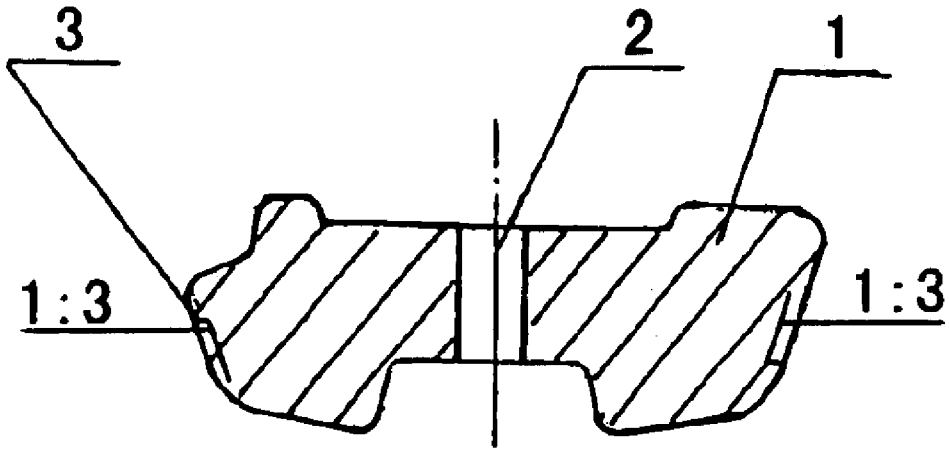

This application claims the benefit of the Chinese Application numbers 01277561.4 and 01138962.1, both filed Dec. 28, 2001.

TECHNICAL FIELD OF THE INVENTION

The present invention relates to a kind of steel, and more particularly, to an Nickel-free high Manganese steel -YW35 steel which has high strength and high tenacity at low temperature, and a fishplate made of the same.

TECHNICAL BACKGROUND OF THE INVENTION

Fishplates used for steel rail are the main fittings of the railway, which demand very strict technical characteristics. The technical specification -TB/T2342.1~4-93 issued by The Railway Department of P.R.C. is executed since 1993, and the fishplate used for steel rail is conventionally made of the $B_7$ steel and the YW52 steel according to the above technical specification.

The chemical compositions of the $B_7$ steel are provided as follows.

C: 0.50~0.62 WT %, Mn: 0.50~0.80 WT %, Si: 0.15~0.35 WT %, p: <0.045 WT %, S: <0.050 WT %, and a balancing amount of Fe.

The mechanical properties of $B_7$ steel and YW52 steel after heat treatment are provided as follows.

Tensile Strength $\sigma_b \geqq 785$ $MP_a$; Yield Strength $\sigma_s \geqq 520$ $MP_a$; Elongation Rate $\delta_s \geqq 9\%$; Reduction rate of Cross Sectional Area $\geqq 20\%$; Brinell Hardness HB: 227~338; Bending Angle: 30°, Bending Property: fine.

The mechanical properties of the fishplate steel used for steel rail according to the American Specification are provided as follows.

Tensile Strength $\sigma_b \geqq 690$ $MP_a$; Yield Strength $\sigma_s \geqq 480$ $MP_a$; Elongation Rate $\delta_s \geqq 12\%$; Reduction rate of Cross Sectional Area $\geqq 28\%$; Bending Angle: 180° (in which d=3a, "d" represents the diameter of the indenter and "a" represents the thickness of the test piece), Bending Property: fine.

It is proved through long term usage that the $B_7$ steel and the YW52 steel are only adaptable from room temperature to −20° C. Since the regional difference in temperature is very great because of the vast territory of China, the $B_7$ steel and the YW52 steel tends to break at low temperature, resulting in accidents occurring in trunk railway, thus disturbing the normal traffic. Presently, with the train being faster, demands on the technical characteristics of the fishplate steel used for steel rail are stricter, therefore, the $B_7$ steel and the YW35 steel can not meet the requirements of the fishplate steel used for steel rail.

SUMMARY OF THE INVENTION

Accordingly, an object of the present invention is to provide a fishplate steel used for steel rail which is adaptable to the low temperature.

Another object of the present invention is to provide a fishplate made of the same steel.

In order to accomplish the above objects, there is provided a YW35 steel for fishplate, which is produced by adding some amount of Molybdenum and the microelement Vanadium and Niobium in a high Manganese steel and reducing the carbon content thereof to thereby improve the low temperature property of the steel, as a result the steel can be applied to the fishplate used for the steel rail.

The YW35 steel of the present invention is produced through chemical composition design, smelting, rolling and heat treatment, said YW35 steel comprising (by weight percentage):

C: 0.32~0.40, Mn: 1.10~1.30, Si: 0.30~0.50, p: <0.035, S: <0.035, Mo: 0.15~0.25, V: 0.06~0.20, Nb: 0.04~0.07, Cu: <0.2, and a balancing amount of Fe.

The low temperature fishplate made of the YW35 steel is a straight stripe steel plate with groove shape section, both side surfaces of the steel plate are working faces with incline of 1 in 3, and in the central portion of the groove are provided with circular apertures at unequal intervals.

The low temperature fishplate made of the YW35 steel of the present invention can be used as the joint clamp for the high speed railway steel rail. The YW35 steel is produced by adding some amount of Molybdenum and the microelement Vanadium and Niobium in a high Manganese steel and reducing the carbon content thereof, to thereby improve the low temperature property of the steel. Through inspections of The Metals & Chemistry Research Institute China Academy Of Railway Sciences, Railway Facilities And Material Laboratory, The mechanical properties of the YW35 steel at different temperature are provided as follows.

Temperature: +14° C.

Tensile Strength $\sigma_b \geqq 785$ $MP_a$; Yield Strength $\sigma_s \geqq 520$ $MP_a$; Elongation Rate $\delta_s \geqq 13\%$; Reduction rate of Cross Sectional Area $\geqq 30\%$; Bending Angle: 180° (in which d=3a, "d" represents the diameter of the indenter and "a" represents the thickness of the test piece), Bending Property: fine.

Temperature: −40° C.

Tensile Strength $\sigma_b \geqq 720$ MP,; Yield Strength $\sigma_s \geqq 520$ $MP_a$; Reduction rate of Cross Sectional Area $\geqq 30\%$; Bending Angle: 180° (in which d=3a, "d" represents the diameter of the indenter and "a" represents the thickness of the test piece), Bending Property: OK; Ballistic Work Akv (longitudinal)$\geqq$20J.

The test proves that the characteristic of the YW35 steel is well at room temperature and low temperature, therefore, the YW35 steel can be applied to the fishplate used for steel rail of the high speed railway.

BRIEF DESCRIBTION OF THE DRAWING

FIG. 1 is a sectional view showing the low temperature fishplate made of the YW35 steel according to the present invention.

DETAILED DESCRIPTION OF THE PREFERRED EMBODIMENTS

The YW35 steel of the present invention is produced through chemical composition design, smelting, rolling and heat treatment. According to the characteristic of the elements, three groups of compositions of the YW35 steel in the trial-manufacture are provided as follows. (by weight percentage)

1. C: 0.32, Mn: 1.10, Si: 0.30, p: <0.035, S: <0.035, Mo: 0.15 WT %, V: 0.06, Nb: 0.04, Cu: <0.2, and a balancing amount of Fe.
2. C: 0.35, Mn: 1.20, Si: 0.40, p: <0.035, S: <0.035, Mo: 0.20, V: 0.13, Nb: 0.05, Cu: <0.20, and a balancing amount of Fe.
3. C: 0.40, Mn: 1.30, Si: 0.50, p: <0.035, S: <0.035, Mo: 0.25, V: 0.20, Nb: 0.07, Cu: <0.20, and a balancing amount of Fe.

Each group produces two steel ingots, each one of the two steel ingots weights 60 Kg. For the convenience of rolling, the steel ingots are forged into flat steel billets, and further rolled into straight strip for making the fishplate used for steel rail, then the straight strip billet is cut into separated fishplate samples to be heat treated.

Referring to FIG. 1, reference number 1 represents the low temperature fishplate made of YW35 steel, reference nember 2 represents the circular apertures, and reference number 3 represents the working faces. The low temperature fishplate made of the YW35 steel 1 is a straight stripe steel plate with groove shape section, both side surfaces of the steel plate are working faces 3 with incline of 1 in 3, and in the central portion of the groove are provided with circular apertures 2 at unequal intervals. The circular apertures 2 are technical apertures.

Through inspections by The Metals & Chemistry Research Institute China Academy Of Railway Sciences, Railway Facilities And Material Laboratory, The mechanical properties of the YW35 steel at different temperature are provided as follows.

Temperature: +14° C.

Tensile Strength $\sigma_b \geqq 785$ $MP_a$; Yield Strength $\sigma_b \geqq 520$ $MP_a$; Elongation Rate $\delta_s \geqq 13\%$; Reduction rate of Cross Sectional Area ≧30%; Bending Angle: 180° (in which d=3a, "d" represents the diameter of the indenter and "a" represents the thickness of the test piece), Bending Property: OK.

Temperature: −40° C.

Tensile Strength $\sigma_b \geqq 720$ MP,; Yield Strength $\sigma_s \geqq 520$ $MP_a$; Reduction rate of Cross Sectional Area ≧30%; Bending Angle: 180° (in which d=3a, "d" represents the diameter of the indenter and "a" represents the thickness of the test piece), Bending Property: OK; Ballistic Work Akv (longitudinal)≧20J.

The test proves that the characteristic of the YW35 steel is well at room temperature and low temperature. Therefore, the YW35 steel can be applied to the fishplate used for steel rail of the high speed railway.

What is claimed is:

1. A YW35 steel, for low temperature fishplate and consisting essentially of:

C: 0.32~0.40 WT %;

Mn: 1.10~1.30 WT %;

Si: 0.30~0.50 WT %;

p: <0.035 WT %;

S: <0.035 WT %;

Mo: 0.15~0.25 WT %;

V: 0.06~0.20 WT %;

Nb: 0.04~0.07 WT %;

Cu: <0.20 WT %; and a balancing amount of Fe.

2. A low temperature fishplate made of the YW35 steel of claim 1, wherein said low temperature fishplate made of the YW35 steel is a straight stripe steel plate with groove shape section, both side surfaces of the steel plate being working faces with incline of 1 in 3, and in the central portion of the groove being provided some circular apertures at unequal intervals.

* * * * *

UNITED STATES PATENT AND TRADEMARK OFFICE

CERTIFICATE OF CORRECTION

PATENT NO. : 6,746,549 B2
DATED : June 8, 2004
INVENTOR(S) : Renzhen Song et al.

It is certified that error appears in the above-identified patent and that said Letters Patent is hereby corrected as shown below:

Title page,
Item [76], Inventors, second inventor delete “LI u” and insert -- Liu --; delete “Lia” and insert -- Liao --; and delete “Zing” and insert -- Xing --.

Signed and Sealed this

Thirteenth Day of December, 2005

JON W. DUDAS
*Director of the United States Patent and Trademark Office*